US006123156A

United States Patent [19]

Dufour et al.

[11] Patent Number: 6,123,156

[45] Date of Patent: Sep. 26, 2000

[54] MID-CHASSIS PLOW OR SCRAPPER ANGLING SUPPORT

[75] Inventors: Martin Dufour; Gervais Dufour, both of Lac St-Jean Ouest, Canada

[73] Assignee: 177197 Canada Ltee, Canada

[21] Appl. No.: 08/837,383

[22] Filed: Apr. 17, 1997

[51] Int. Cl.[7] ..... E02F 3/12

[52] U.S. Cl. ..... 172/795; 172/797; 172/794

[58] Field of Search ..... 172/791, 794, 172/795, 797, 684.5; 37/263, 266, 268, 279, 235, 231, 232

[56] References Cited

U.S. PATENT DOCUMENTS

| | | | |
|---|---|---|---|
| 414,674 | 11/1889 | Bronson | 172/791 |
| 1,460,930 | 9/1923 | Walters | 172/795 |
| 1,747,747 | 2/1930 | Walters | 172/797 |
| 1,875,194 | 8/1932 | Sherman | 172/797 |
| 1,932,601 | 10/1933 | Price | 172/795 |
| 2,062,544 | 12/1936 | Weeks | 172/794 |
| 2,698,491 | 1/1955 | Felt | 172/797 |
| 3,007,266 | 11/1961 | Brand | 172/791 |
| 4,031,966 | 6/1977 | Farrell | 172/794 |
| 4,074,448 | 2/1978 | Niemela | 37/41 |
| 4,304,307 | 12/1981 | Anderson | 172/797 X |
| 4,337,832 | 7/1982 | Whitlow | 172/265 |
| 4,553,608 | 11/1985 | Miskin | 172/197 |
| 4,665,636 | 5/1987 | Borras | 37/234 |
| 4,680,880 | 7/1987 | Boneta | 37/236 |
| 4,913,070 | 4/1990 | Morrison, Jr. | 172/4 X |
| 5,265,356 | 11/1993 | Winter | 37/234 |

FOREIGN PATENT DOCUMENTS

| | | | |
|---|---|---|---|
| 766667 | 1/1957 | United Kingdom | 172/797 |

*Primary Examiner*—Victor Batson

[57] ABSTRACT

A mid-chassis, underbody plow or scrapper blade is mounted under a vehicle chassis to permit the outer ends of the blade to move vertically. Pneumatic pressure actuators mounted on either side of the center line of the vehicle apply pressure to the respective ends of the blade to control the scrapping action.

11 Claims, 8 Drawing Sheets

MID-CHASSIS PLOW OR SCRAPPER ANGLING SUPPORT

FIELD OF THE INVENTION

This invention relates to plowing equipment. More particularly, it relates to a support system for a mid-chassis, underbody plow or scrapper system that controls the deployment of a blade and its orientation to the surface being scrapped. The invention is suited especially for installation on the underbody of trucks used as snow plows.

BACKGROUND OF THE INVENTION

Mid-chassis or underbody plows and scrappers are well known vis. U.S. Pat. Nos. 4,031,966; 4,337,832. It is also known to provide scrappers that are positioned in pairs on a vehicle, between the front and rear tires vis. U.S. Pat. No. 4,665,636. In this latter arrangement, the scrappers are independently vertically adjustable in terms of the positions of the lower edges of the blades below the vehicle chassis.

It is also known to relieve the weight of a snowplow blade resting on a road surface through the controlled application of an hydraulically lifting force to the plow blade, vis U.S. Pat. No. 5,265,356. Alternately, it is known to position a light weight scrapper array vertically using two hydraulic cylinders, cf U.S. Pat. No. 4,553,608.

A further known arrangement in the field of plowing blade supports is to provide an air-cushioned positioning system that holds a plowing blade in an upright orientation until an obstruction is struck, whereupon the blade will "trip" to pass over the obstacle, cf U.S. Pat. No. 4,031,966.

In designing an underbody plow or scrapper it is desirable to provide adjustability to raise or lower the blade, to rotate the blade up and down at its outer ends about a horizontal axis that is generally pointed in the direction of motion and to angle the blade to the left and right about a vertical axis. It is also desirable when the plow blade is light, to provide a supplementary force-control mechanism that will apply a downward force to the plow blade to maintain it in contact with the surface being plowed with the appropriate level of pressure.

These features of control should ideally be achievable, in whole or in part, at minimal cost and with a minimal addition of weight to the vehicle. Fluid hydraulic systems are capable of serving in such applications, but they are relatively expensive and heavy.

It is therefore an object of the invention to provide an underbody blade support system that has features of adjustability combined with simplicity and low cost.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

The invention is to be used with an underbody plow blade or scrapper with two outer ends, (hereafter referred to generally as a scrapper blade) which is mounted to extend transversely beneath the chassis of a vehicle. This scrapper blade is positioned between the forward and rearward sets of wheels on the vehicle. It is carried by a chassis mount connected to the chassis, preferably in the form of a pivot arm assembly having two trailing arms that are mounted at their forward ends to the chassis so as to extend downwardly from a hinge mount that allows rotation of the pivot arm assembly about an axis that is generally transverse to the direction of motion of the vehicle. Other means of supporting the blade are, however, permissible.

The scrapper blade is carried as part of a blade support frame with two separated blade support arms that are part of a support frame that lies beneath the vehicle chassis. The blade is supported in such a manner that its outer ends are capable of a degree of independent vertical displacement with respect to the vehicle chassis. This is effected by providing a rotatable coupling between the blade support frame carrying the scrapper blade and the chassis mount so as to allow the scrapper blade to rotate about a forwardly directed, generally horizontal axis.

It is a further feature of the invention that two pneumatic pressure actuators respectively position the blade vertically beneath the vehicle chassis. These actuators are positioned at spaced locations on either side of the centerline of the vehicle to apply downward pressure on the two arms of the blade support frame. As an optional feature, by independent control of the pressure actuators, differing vertical forces may be applied to the respective outer ends of the scrapper blade. Consequently a greater amount of contact pressure may be maintained between the scrapper blade and the surface being scrapped at one outer end of the blade than at the other outer end. This greatly facilitates the removal of snow, ice or other debris from a road surface when the level of material to be removed is higher on one side of the vehicle than on the other side of the vehicle.

The preferred type of pressure activator is a pneumatic bladder of the type generally employed in truck vehicle air springs. Their role is to press the blade edge resiliently against the road surface, lifting-off ice, snow and debris from that surface. Such devices are not only relatively inexpensive, but also provide a "spring" resilience with a shallow spring schedule that allows the scrapper to move vertically to accommodate vertical variation in the surface being scrapped while still applying scrapping pressure to the road surface.

To raise the scrapper blade, the pivot arm assembly may be provided with a lifting actuator coupled between the pivot arms and the vehicle chassis. Preferably this lifting actuator is also an air bladder seated on the vehicle chassis and having on its upper side a coupling link that extends down to the pivot arm assembly. In one version of the invention this coupling link may be provided by a transverse bar and two descending chains. The chains transmit a lifting force but do not impede vertical movement of the scrapper blade as it complies with the profile of the highway.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
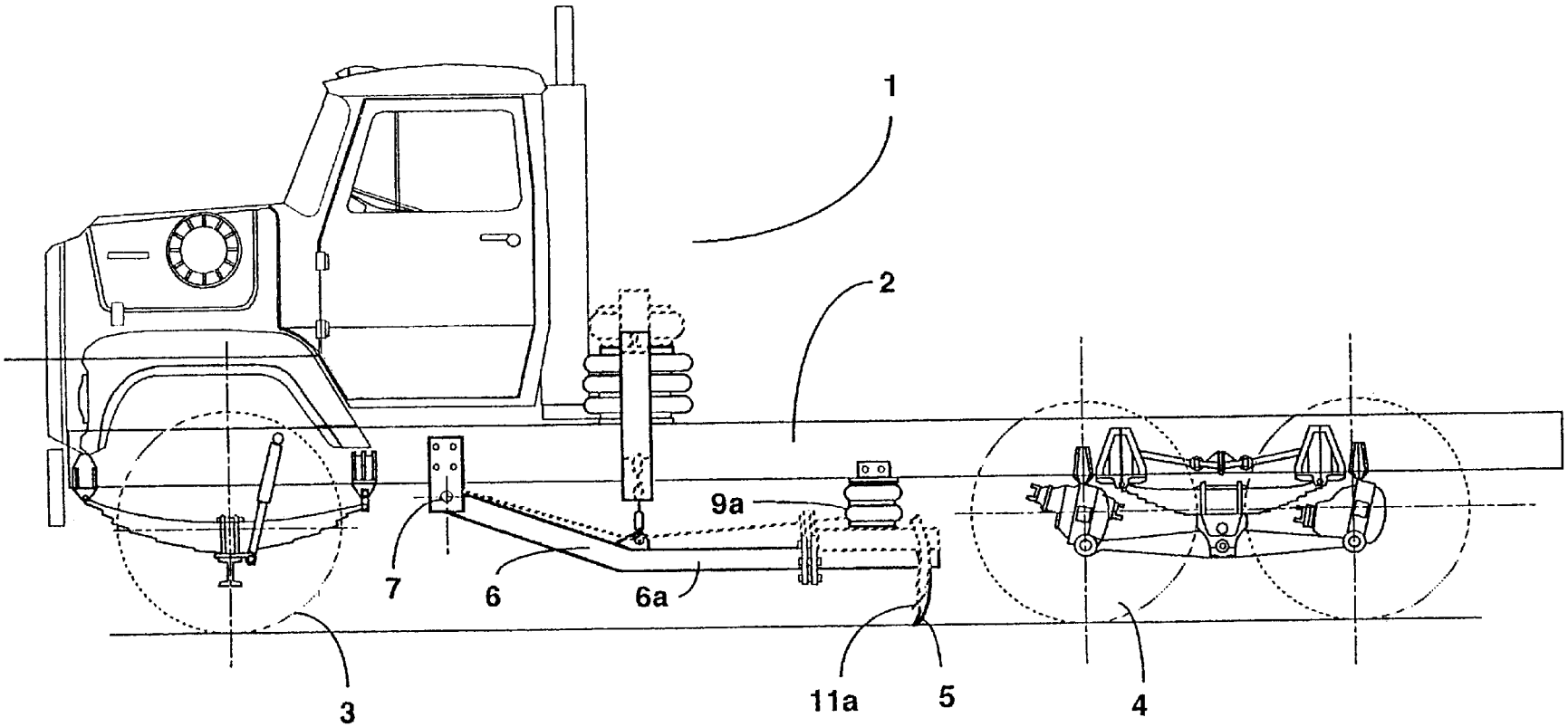
FIG. 1 is a side view of a vehicle carrying a mid-chassis, underbody plow with a blade support structure in accordance with the invention.

In FIG. 1 a vehicle 1 having a chassis 2, forward wheels 3 and rearward wheels 4 carries between these sets of wheels 3,4 a scrapper blade or plow blade 5. While reference hereafter will be made to a "blade" 5 this language is intended to encompass any form of scrapper or plowing blade, including rake and chisel-like constructions.

The blade 5 is carried by a chassis mount in the form of a pivot arm assembly 6 having two pivot arms 6*a*, 6*b* that trail below the chassis 2 from hinges 7 coupled to the chassis 2 at the forward end of each pivot arm 6*a*,6*b*. The hinges 7 permit rotation of the pivot arms 6*a*,6*b* about an axis that is transverse to the direction of the vehicle 1 and, in turn, allow the blade 5 to move within a generally vertical plane.

Positioned between the chassis 2 and blade 5 are two sets of pneumatic bellows 9*a*,9*b* respectively mounted on opposite sides of the centerline 10 of the vehicle 1. Based on pneumatic springs, these bellows 9*a*,9*b* act as controllable pressure actuators which are able, in a preferred arrangement, to apply independently differing pressures to the outer ends 11*a*,11*b* of the blade 5.

Figure 2:
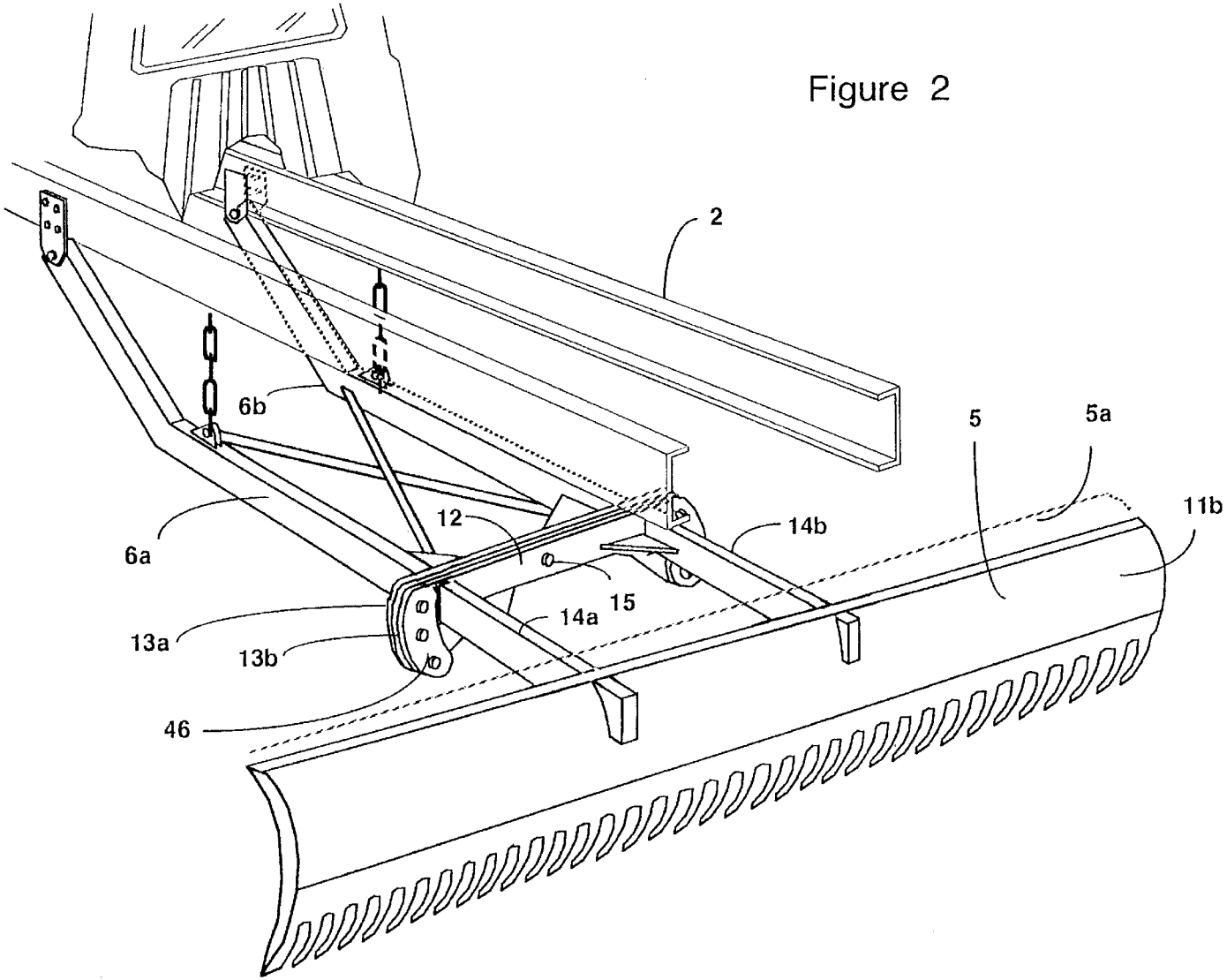
FIG. 2 is a perspective view of a cut-away portion of the vehicle of FIG. 1 taken from the left rear quarter without pneumatic actuators present.
Figure 4A:
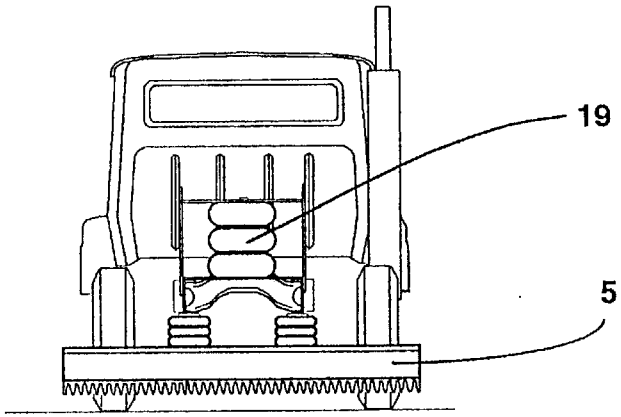
FIG. 4*a* is a rearward view of the vehicle of FIG. 1 with the pivot arm assembly raised.
Figure 4B:
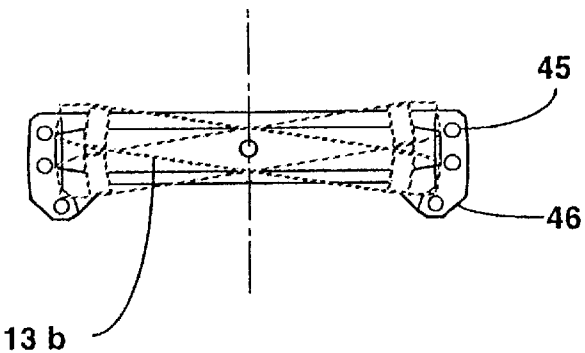
FIG. 4*b* shows a rearward face view of the tilting plate assembly.
Figure 4:
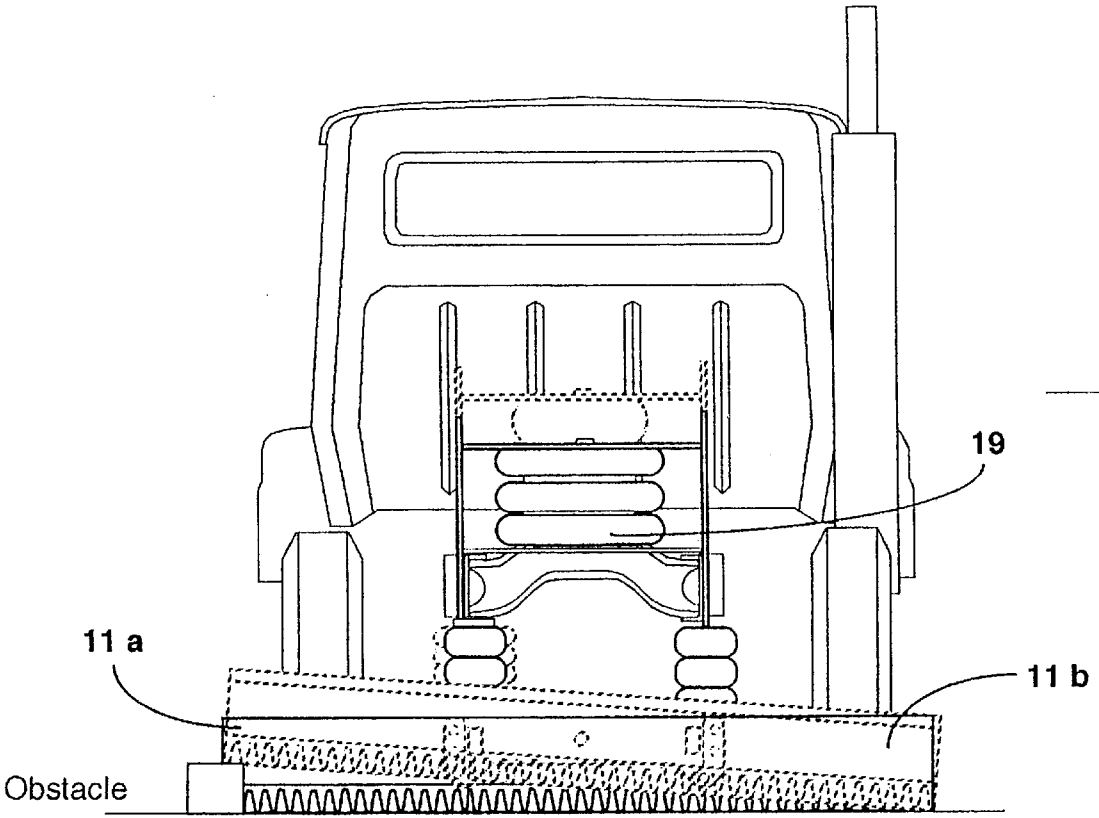
FIG. 4 is a rearward view of the vehicle of FIG. 1 with the pivot arm assembly lowered.

As best seen in FIGS. 2, 4 and 4*b* the outer ends 11*a*,11*b* of the blade 5 are rendered vertically displaceable by the presence of a rotary coupling 12 incorporated into a pair of transverse tilting plates 13*a*,13*b*. A first one of these plates 13*a* extends between the pivot arms 6*a*,6*b*; the second of these plates 13*b* extends between two blade support arms 14*a*, 14*b* that connect to the blade 5. A central pin 15 coupled to the two tilting plates 13*a*,13*b* permits rotation of the blade support arms 14*a*, 14*b* and blade 5 about a horizontal axis aligned with the direction of travel 10 of the vehicle 1.

The plates 13*a*, 13*b* preferably are positioned closely together so that their outer ends may brush together to absorb dislocating forces that tend to swivel the blade 5 to the left or right. As well, welded pins or bolts 45 may extend from one plate 13*a* to carry a containment plate 46 that contains or "traps" the outer ends of the second plate 13*b* so that the pulling force of the vehicle can be transmitted through such plates to the plow blade. Alternately, in a reverse arrangement, second plate 13*b* may carry the containment plate 46, embracing the first plate 13*a*. This arrangement is intended to absorb tensional forces while permitting vertical movement between the plates 13*a*, 13*b*. Specific bearing surfaces may be provided between the plates 13*a*, 13*b* and containment plate 46 to absorb the brushing contact action.

In FIG. 2 the alternate position of the blade 5 is shown in ghost outline 5*a* with one end 11*b* raised and the other end 11*a* lowered.

Figure 3:
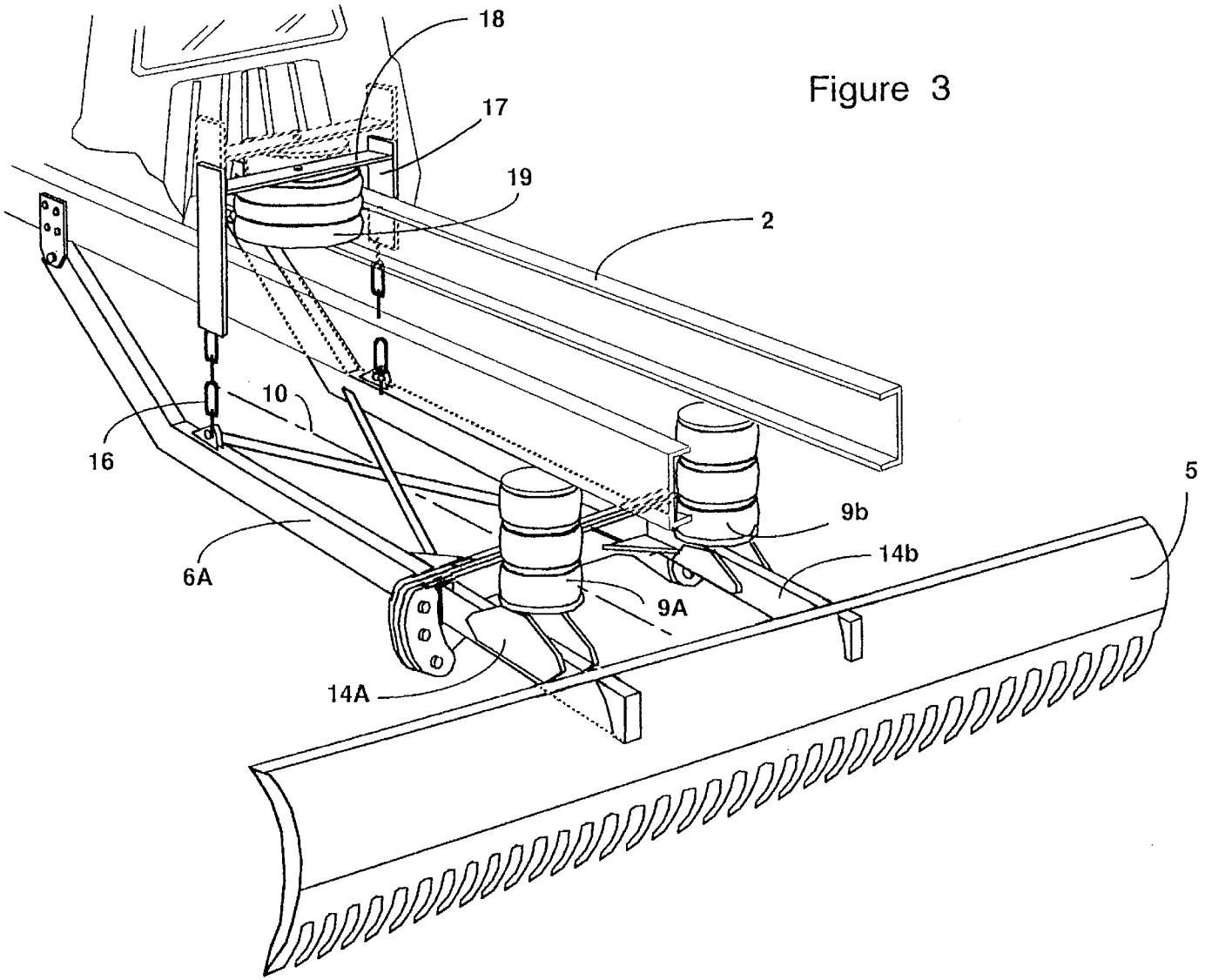
FIG. 3 is the view of FIG. 2 with pneumatic actuators depicted in position.

In FIG. 3 the pneumatic bellows 9*a*,9*b* omitted from FIG. 2 for clarity are shown positioned to apply force between the chassis 2 and the blade 5 through the respective blade support arms 14*a*, 14*b*. These pressure actuators 9*a*,9*b* are spaced apart and positioned to apply similar or differing pressures at the outer ends of the blade 5 in pressing the blade ends downward onto the road surface.

The pivot arm assembly 6 is raised by chains 16 descending from a frame 17 that includes a transverse bar 18 that overlies a further air spring lifting bellows 19 positioned on the chassis 2. The pivot arms 6*a*, 6*b* are coupled to the chains 16 at locations between their ends to provide the action of a third class lever.

To raise the blade 5, the pressure in the pressure actuator bellows 9*a*,9*b* is released (through valves 24) and that in the lifting bellows 19 is increased. The force of the lifting bellows 19 is transmitted through the frame 17 and chains 16 to the pivot arm assembly 6 raising the blade 5 upwardly off of the surface being scrapped. This operation may be seen in FIGS. 4 and 4*a* wherein the pivot arm assembly is respectively lowered and raised.

Figure 5:
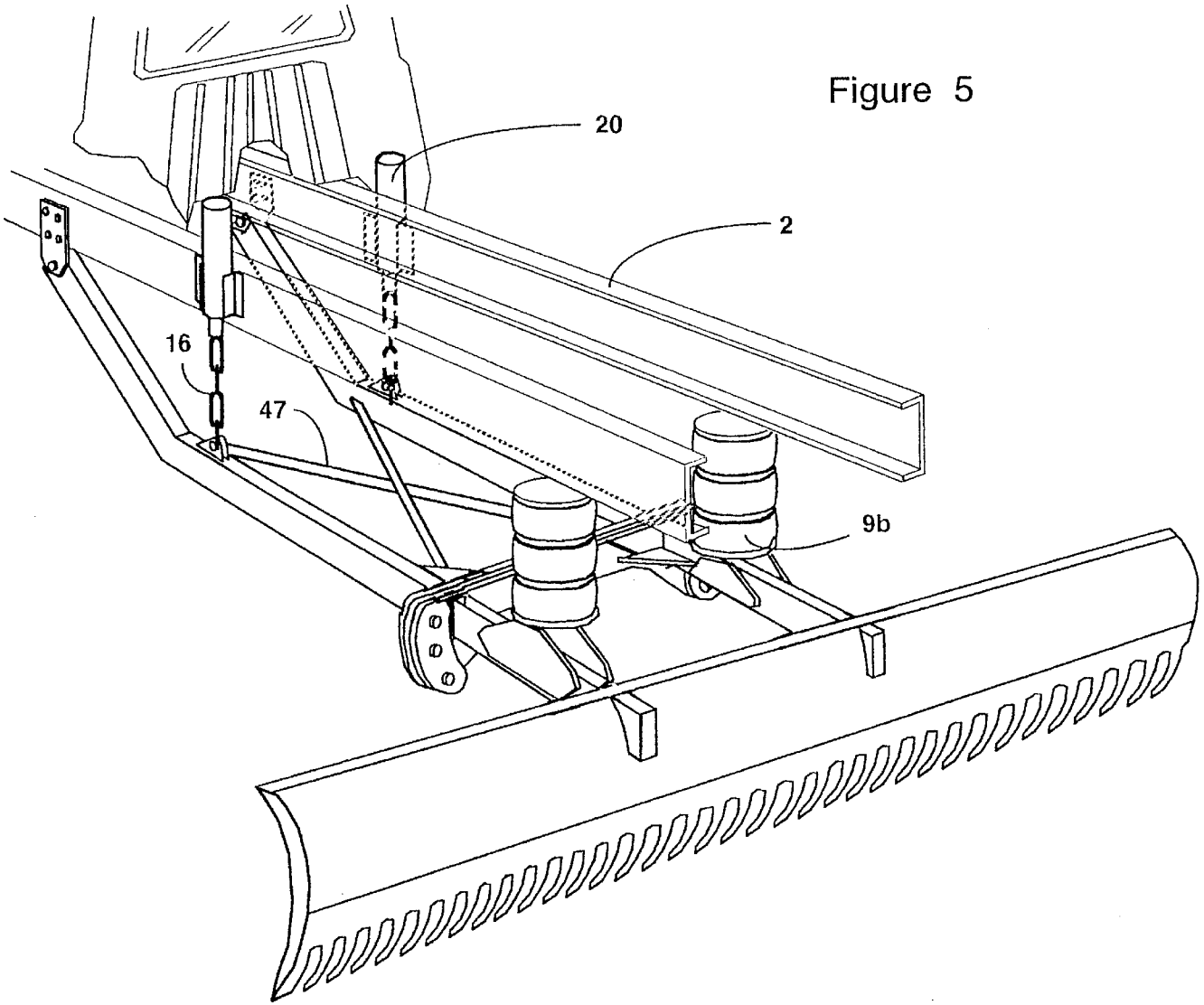
FIG. 5 is a perspective view of the vehicle as in FIG. 3 with dual air cylinders in place of the pneumatic lifting bellows.

As an alternative to a lifting bellows 19 of FIG. 3, the chains 16 may terminate in two respective air cylinders 20 or the like mounted on the vehicle chassis 2 as shown in FIG. 5. Also shown in FIG. 5 are optional crossed bracing struts 47 extending between the pivot arms 6*a*,6*b* to increase the stiffness of the pivot arm assembly 6.

Figure 6:
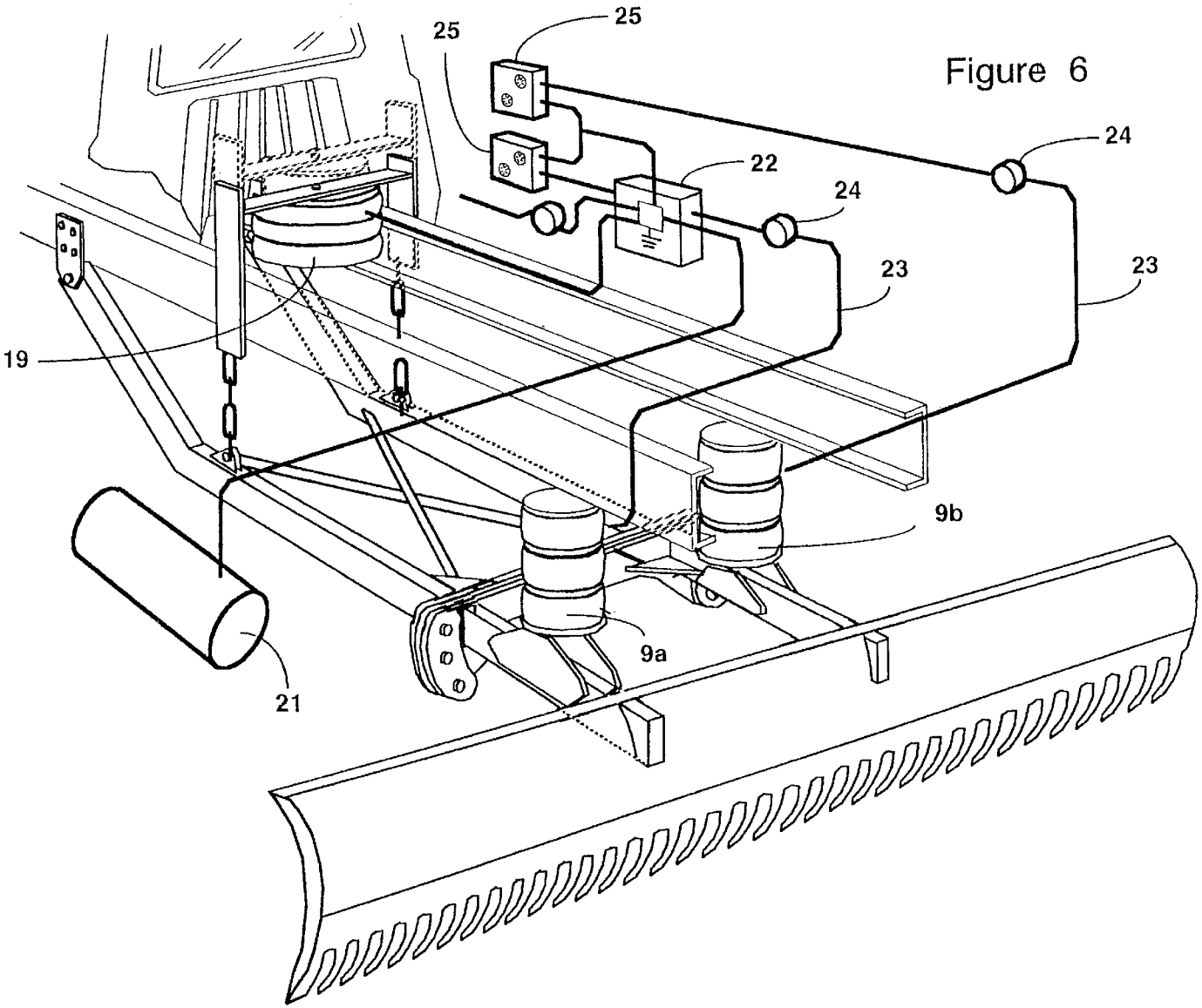
FIG. 6 depicts the vehicle as in FIG. 3 with the air distribution and control system in place.

The control system for the blade support is depicted in FIG. 6. A source of pressurized air 21, depicted as an air tank, provides air to a pressure distribution box 22. Pressurized air is directed from this box 22 to the lifting bellows 19 and pressure actuator bellows 9*a*,9*b*, through air lines 23 in response manually set input signals, preferably originating remotely from within the vehicle cab. Exhaust valves 24, responding in cooperation with the operation of the pressure distribution box 22, exhausts or vents air from bellows 9*a*,9*b*,19 when they are to be depressurized, e.g. venting lifting bellows 19 when pressure actuators 9*a*,9*b* are pressurized. Manometers 25 display the pressure conditions within the system.

Through the pressure distribution box 22, controlled levels of pressure may preferably be developed independently in each of the bellows 9*a*,9*b* controlling the scrapping effect of the blade 5 on the road surface. A different pressure need not necessarily be applied through the bellows 9*a*,9*b*; but such option is available.

Figure 7:
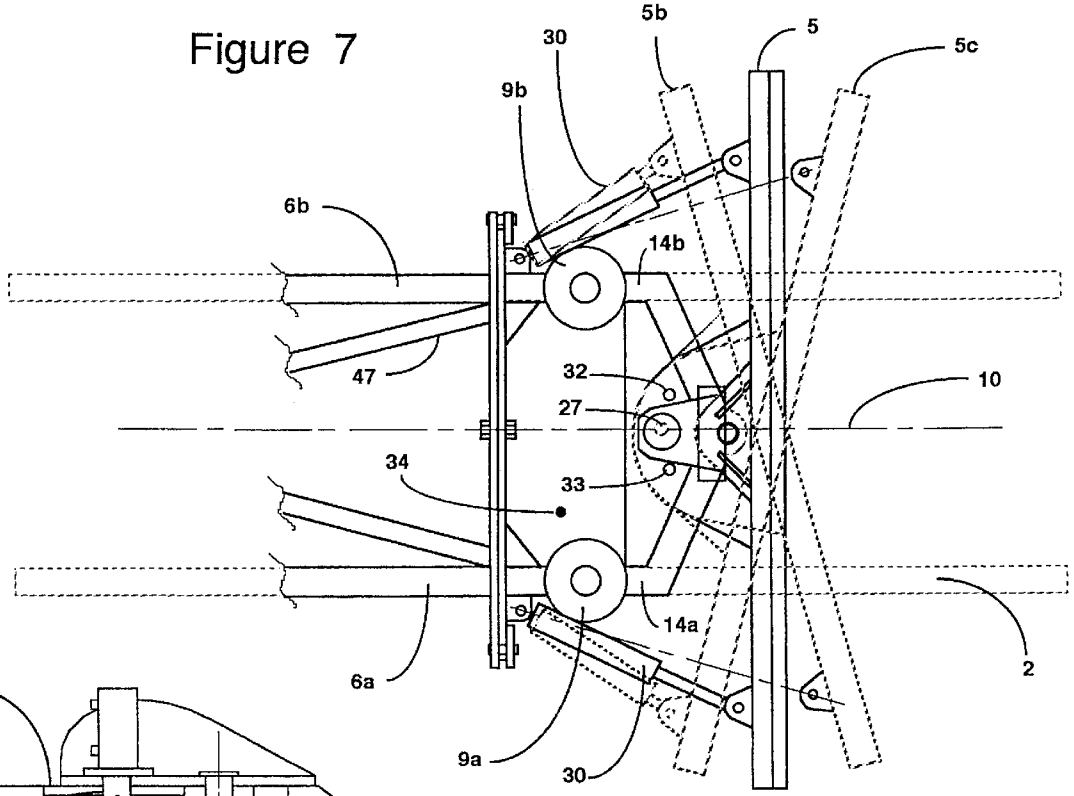
FIG. 7 depicts in plane view a further blade control structure whereby the blade may be swivelled to the left and right about a swivel joint.
Figure 8:
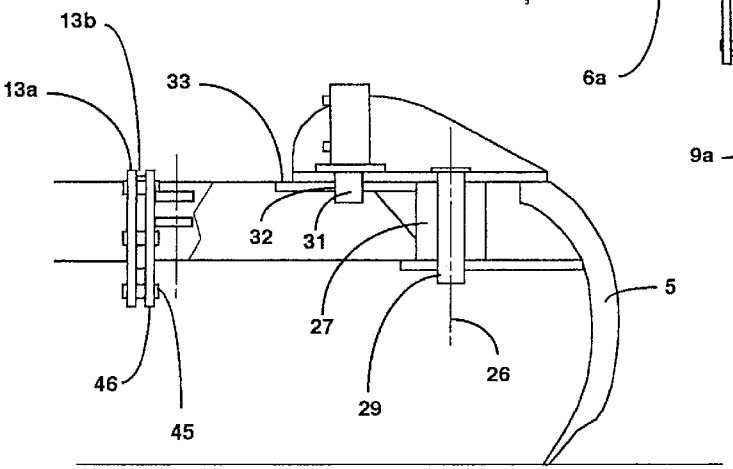
FIG. 8 is a detailed cross-sectional side view of the swivel joint of FIG. 7.

In FIGS. 7 and 8 an improvement to the system is shown wherein the blade 5 is capable of swivelling in a horizontal plane, about a vertical axis 26 to provide for a skewed angle of attack by the blade 5 and the shifting of gathered snow and ice to either side of the vehicle. The two blade support arms 14*a*,14*b* carry a swivel coupling 27 with a vertical axis 26. A reinforcing plate 34 stiffens the blade support arms 14*a*,14*b*. A swivel pin 29 rotationally joins the blade 5 to swivel coupling 27. One or two control cylinders 30 may be used to position the blade 5 for sideways orientation. Optionally with or without such cylinders 30, a locking pin 31 carried by the blade structure may engage a series of indexing holes 32 on a positioning plate 33 fixed to the swivel coupling 27. With such locking pin 31 present the blade 5 may be positioned manually, but for security the locking pin 31 may be combined with the use of powered positioning cylinders 30. The locking pin 31 may be power actuated, as by an air cylinder or electrical solenoid, in order to allow for remote control.

As shown in FIG. 7, a blade 5 so mounted may take alternate positions shown in ghost outline 5*b*,5*c*. Combined with rotation of the blade 5 about a horizontal axis, great versatility in the control of the blade's action may be obtained. Alternately, the swivelling portion of the described structure may be fixed directly to the pivot arms 6*a*,6*b* with the rotary coupling 12 not present in the system to provide a simplified version of this blade support system.

Figure 9:
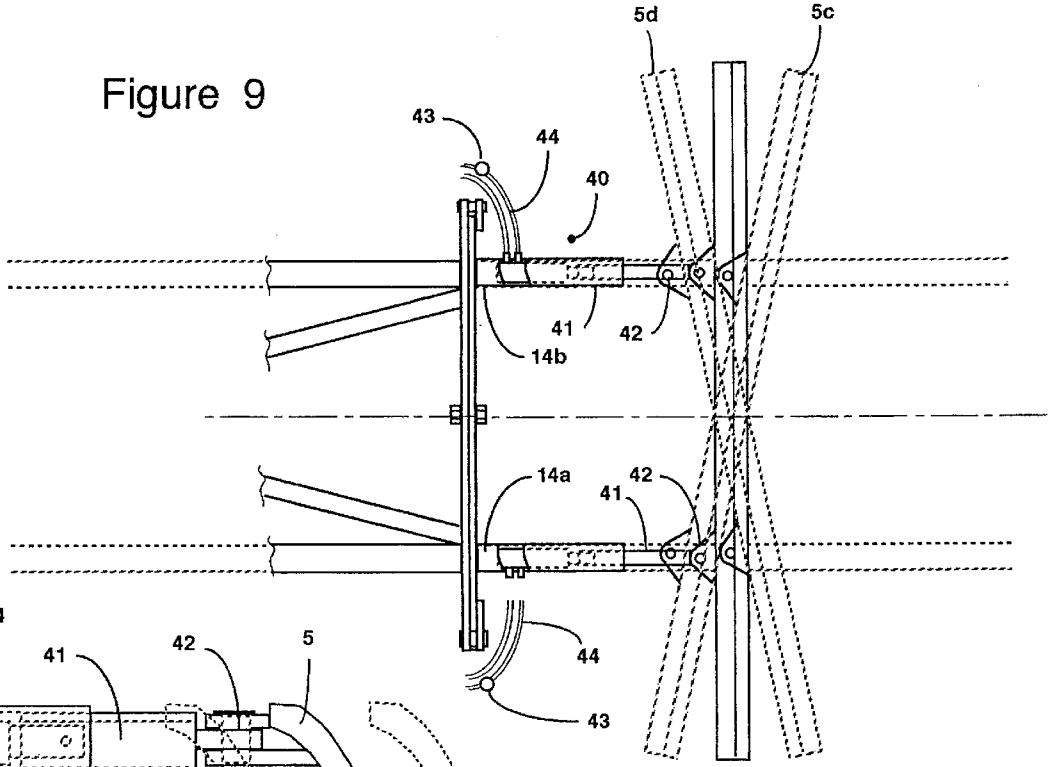
FIG. 9 is a plan view of a plow wherein the blade is mounted by telescopic support means.
Figure 10:
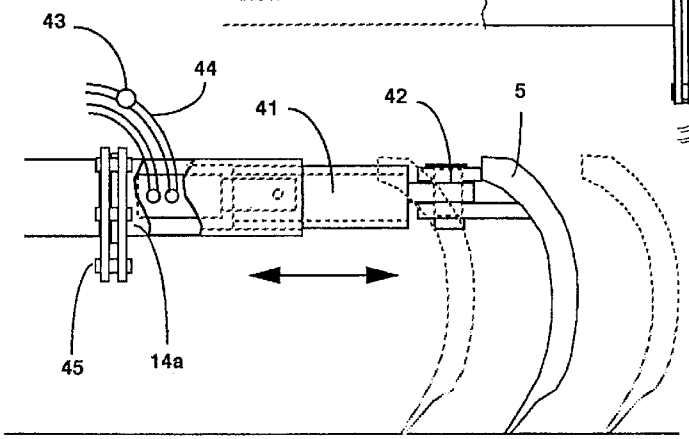
FIG. 10 is a side view of the arrangement of FIG. 9.

According to a further alternative arrangement, the blade 5 may be mounted for angular positioning (to the left or right) by providing extensible, telescopic joints 40 in the lade support arms 14*a*,14*b*. This is preferably effected through use of hydraulic cylinders 41 as depicted in FIGS. 9 and 10.

Respective hydraulic cylinders 41 are mounted at one end on each of the blade support arms 14*a*,14*b*, and are coupled at their other end through hinged joints 42 to the blade 5. One of the blade support arms 14*a*,14*b* may be hinged at its root (hinge not shown) where it connects to the tilting plate 13*b* to accommodate geometrically imposed displacements. Though two cylinders 41 are shown and are preferred as telescopic positioning means 40, one cylinder 41 may be replaced by a solid coupling ending in a hinge joint 42, with the remaining cylinder 41 still being adjustable. By extension and retraction of this telescopic positioning means 40 the blade 5 may be angled as desired to deposit debris to the left or right of the vehicle 1, cf. blade 5*d*,5*e*.

An advantage of the use of hydraulic cylinders 41, and particularly two hydraulic cylinders 41, as the telescopic positioning means 40, is that a pressure relief valve 43 located in the hydraulic lines 44 may release the blade 5 if a major obstruction is struck by the blade 5. If air cylinders are used for this purpose (not shown), there will be some resilience present in the telescopic support means 40. In either case, this linear configuration for supporting a blade 5 at various lateral angles has the advantage of being light in weight.

The use of air-activated pressure actuators 9*a*,9*b* will render the blade support of the invention light in weight and less costly than hydraulic systems. The light weight of the blade 5 and pivot arm assembly is supplemented by pressure applied through the bellows 9*a*,9*b* which respond resiliently to variations in the height of the road surface. The pneumatic pressure actuators 9*a*,9*b* are preferably of relatively large diameter in order that the downward pressure will not change substantially with vertical motion of the blade support arms 14*a*,14*b*.

The rotary coupling 12 in the pivot arm assembly allows the scrapper blades to adjust to the contour of the road surface. The angling feature of the blade 5 allows debris to be transferred to the left or right side of the vehicles. Individually and collectively an improved means is provided for clearing a road surface.

Conclusion

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

What is claimed is:

1. A vehicle underbody scrapper blade support system for mounting on a vehicle having a chassis and forward and rearward sets of wheels comprising:

(1) a chassis mount for coupling to the chassis of a vehicle to support a scrapper blade at a location intermediate said forward and rearward sets of wheels on said vehicle, said chassis mount comprising a pivot arm assembly, the pivot arm assembly carrying at its rearward end a blade support frame, and at its forward end a hinge means adapted to be attached to a vehicle chassis to allow the pivot arm assembly to pivot in a vertical plane;

(2) a scrapper blade with outer ends carried by said blade support frame and extending generally transversely with respect to said vehicle;

(3) said blade support frame being connected to the pivot arm assembly at the rearward end of said assembly through rotational coupling means to permit rotation of the blade support frame about a forwardly directed horizontal axis to permit the outer ends of the scrapper blade to effect respective displacements in the vertical direction;

(4) two pneumatic pressure actuators positioned respectively between the blade and the vehicle chassis, at spaced locations on either side of the centerline of the vehicle to apply downward pressure on the blade; and (5) pressure actuator control means connected to the pressure actuators by which the pressure applied by the pressure actuators can be controlled wherein tho rotational coupling means comprises a pair of transverse tilting plates, one of said plates being carried by the pivot arm assembly, and the other of said plates forming part of the blade support frame, said plates being joined through a rotational joint whereby the scrapper blade is able to rotate about a horizontal axis generally aligned with the direction of travel of the vehicle, thereby permitting the outer ends of the scrapper blade to effect complimentary displacements in the vertical direction, whereby the scrapper blade may be pressed resiliently against a road surface for lifting-off ice, snow and debris from the surface by pivoting about the hinge means located at the forward end of the pivot arm assembly.

2. A blade support system as in claim 1 wherein the pressure actuator control means permits independent control of the pressure actuators whereby different vertical forces may be applied to the respective outer ends of the scrapper blade.

3. A blade support system as in claim 1 wherein one of the tilting plates carries a containment plate to contain the outer ends of the other tilting plate while permitting the transmission of an applied force from one plate to the other.

4. An underbody scrapper blade support system for a vehicle having a chassis and forward and rearward sets of wheels for traversing a road surface comprising:

(1) a scrapper blade mounted on a blade support frame, the blade having outer ends for extending generally transversely with respect to said vehicle, (2) the blade support frame being positioned to be carried by the chassis through a rotational coupling means that is centrally mounted with respect to said vehicle between the rearward and forward sets of wheels to permit the outer ends of the scrapper blade to be reciprocally displaced within a vertical plane;

(3) resilient pressure actuator means positioned to apply to vertical pressure to the scrapper blade, directing such blade to press resiliently against a road surface beneath the vehicle; and (4) pressure actuator control means by which the pressure applied by the pressure actuator means can be controlled whereby the scrapper blade may be pressed resiliently against the road surface for lifting ice, snow and debris from the road surface, wherein the rotational coupling means comprises a pair of transverse tilting plates, one of said plates being carried by a chassis mount for attachment to the vehicle chassis, and the other of said plates forming part of the blade support frame, said plates being joined by a rotational joint whereby the scrapper blade is able to rotate about a horizontal axis generally aligned with the direction of travel of the vehicle, thereby permitting the outer ends of the scrapper blade to effect complimentary displacements in the vertical direction.

5. A blade support system as in claim 4 having dual pressure actuators wherein the pressure actuator control means permits independent control of said dual pressure actuators, whereby different vertical forces may be applied to the respective outer ends of the scrapper blade.

6. A blade support system as in claim 5 wherein one of the tilting plates carries a containment plate to contain the outer ends of the other tilting plate while permitting the transmission of an applied force from one plate to the other.

7. A blade support system as in claim 6 wherein the pressure actuators are pneumatic bladders.

8. A blade support system as in claim 5 wherein the pressure actuators are pneumatic bladders.

9. A blade support system as in claim 4 chassis mount comprises a pivot arm assembly adapted to be coupled to said chassis at the forward end of the chassis through a hinge means that allows the assembly to rotate about a pivot arm axis that is generally transverse to the direction of motion of the vehicle.

10. A blade support system as in claim 7 wherein the pressure actuators are pneumatic bladders.

11. A blade support system as in claim 4 wherein the pressure actuators are pneumatic bladders.

* * * * *